US005779854A

United States Patent [19]

Sandmeier

[11] Patent Number: 5,779,854

[45] Date of Patent: Jul. 14, 1998

[54] ADHESIVE APPLICATION DEVICE

[75] Inventor: Hermann Sandmeier, Bielefeld, Germany

[73] Assignee: Windmöller & Hölscher, Lengerich/Westf., Germany

[21] Appl. No.: 795,322

[22] Filed: Feb. 4, 1997

[30] Foreign Application Priority Data

Feb. 9, 1996 [DE] Germany ..... 196 04 761.7

[51] Int. Cl.[6] ..... B05C 1/00

[52] U.S. Cl. ..... 156/578; 118/247; 118/250; 118/262

[58] Field of Search ..... 156/518; 118/247, 118/250, 251, 258, 261, 262

[56] References Cited

FOREIGN PATENT DOCUMENTS

3936774C2 4/1993 Germany .

4324631C2 9/1996 Germany .

*Primary Examiner*—James Engel

*Attorney, Agent, or Firm*—Evenson, McKeown, Edwards & Lenahan, PLLC

[57] ABSTRACT

An adhesive application device includes an adhesive chamber for containing adhesive, an adhesive roll which dips partially into the adhesive, and an adhesive application roll or block roll for applying glue onto a workpiece guided past the block roll by a clamping device. In the absence of a workpiece, a turning axis of the block roll is swung away from the clamping device on an eccentric axis which does not coincide with the rotational axis of the adhesive roll. The turning axis of a block cylinder or the turning axis of an adhesive roll is guided so as to be movable in such a manner that the distance of the block roll from the adhesive roll remains constant.

12 Claims, 5 Drawing Sheets

ADHESIVE APPLICATION DEVICE

BACKGROUND OF THE INVENTION

1. Field of the Invention

This invention pertains to an adhesive application device which includes an adhesive chamber for accepting adhesive, an adhesive roll which dips partially into the adhesive, and an adhesive application roll or block roll for applying adhesive onto a workpiece guided past the block roll by a clamping device. In the absence of a workpiece, the turning axis of the block roll is swung away from the clamping device on an eccentric axis which does not coincide with the rotational axis of the adhesive roll.

The adhesive chamber for accepting adhesive has a front side which is partly closed by an adhesive roll having a vertical turning axis which , together with a vertical lateral wall of the chamber, borders a return opening for adhesive deposits which are not removed. The front side of the adhesive chamber is also partly closed by a sealing roll, parallel to the adhesive roll, which, together with the adhesive roll, forms a passage for adhesive, and which is sealed with respect to the other vertical lateral wall of the chamber by a seal. An adhesive application roll or block roll is adjustable relative to the adhesive roll. The adhesive application roll or block roll takes over the preferably formatted glue deposits from the adhesive roll and transfers the deposits to a workpiece to be provided with an adhesive coating. A driven pivoted adjusting lever supports the block roll eccentric to the pivot axis of the adjusting lever with an eccentricity that is less than the radius of the block roll. This lever moves the block roll away from the workpiece carrier in the absence of a workpiece to be provided with an adhesive coating.

2. Description of Related Art

An adhesive application device of this type is known, for example, from DE-19,532,582.6. In a device of this type, a block roll must be disengaged from a workpiece carrier consisting, for example, of a clamping cylinder when the carrier is not transporting a workpiece to be provided with an adhesive coating. This disengagement is necessary so that adhesive deposits do not clog the workpiece carrier or clamping cylinder.

In disengaging a block roll from a workpiece carrier, the clearance of the block from the adhesive roll must remain unchanged, as much as possible, so that uniformity of the adhesive deposited on the block is not impaired and so that the block is not pinched.

A pivoted support for a block roll is described with the aid of FIGS. 3–5 of the drawings. In this construction, when the block roll is disengaged from a workpiece carrier, the clearance between the turning axis of the block roll and the turning axis of the adhesive roll remains constant. A block roll (2) provided with a block (3) is pivoted, in an arrangement of bearings (6), on a lever (4). The lever (4) is pivoted about a turning axis (5) of an adhesive roll (1). The path of continuously transported workpieces which are to be provided with an adhesive coating is indicated by an arrow A. If the block roll (2) is to be disengaged from a workpiece carrier, a drive such as a pneumatic cylinder (7) is operated. The drive swings the lever (4) between limit stops (8,9) fixed to the framework of the device. The turning axis of the block cylinder (2) is shifted on an external cylinder as the lever (4) swings, as indicated by an arrow B, but stays concentric with the turning axis (5) of the adhesive roll (1). As a result, the clearance between the turning axis of the block cylinder and the turning axis of the adhesive roll (1) does not change. It is evident from FIG. 4 that the block (3) of the block cylinder (2) removes adhesive deposits of the same thickness from the adhesive roll (1) at any pivoting position of the adjusting lever (4). FIG. 5 shows that when swinging the adjusting lever (4), the block (3) is not subject to a change in clearance from the sleeve of the adhesive roll (1).

The arrangement illustrated in FIGS. 3–5 nonetheless has the disadvantage that the block roll (2) is supported on a relatively long lever and at a relatively great distance from the swiveling axis of the lever. The lever must be swung by a relatively small swiveling angle in order to disengage and engage the block roll. When swinging is carried out, a considerable mass must be accelerated and braked sharply. This is problematic at the high speed with which engagement and disengagement is carried out due to the high inertia force resulting from great acceleration.

When disengaging and engaging a block roll, in order to more easily overcome the mass to be accelerated and braked, it is known, in a device of the aforementioned type as illustrated in FIGS. 6–8, to support a block roll (2) on a shorter lever (10). The swiveling axis (11) of the lever has a clearance with respect to the turning axis (12) of the block cylinder (2) which is less than the radius of the block roll. Nevertheless, this arrangement has the disadvantage, as is evident from FIG. 7, that when the block roll (2) is swung away from the workpiece carrier, the turning axis (12) of the block cylinder is swung to a position (12') in which it deviates inwardly from the external cylinder (B), with radius R, concentric to the turning axis (5) of the adhesive roll (1). The turning axes (12,5) of the block roll and adhesive roll, therefore, approach each other and the block is pinched in the way evident from FIGS. 7 and 8. This pinching, which prevents adhesive from being taken up in a uniform manner while the printing block is disengaged, is a disadvantage, but has been accepted in the past.

SUMMARY OF THE INVENTION

The purpose of the invention is to create an adhesive application device of the aforementioned type which, while decreasing the inertia resulting from acceleration when a block roll is disengaged from or engaged with the workpiece carrier, does not change the distance between the turning axis of the block roll and the turning axis of the adhesive roll.

In accordance with the invention, this problem is solved for an adhesive application device of the aforementioned type by guiding the turning axis of a block cylinder or the turning axis of an adhesive roll so as to be movable in such a manner that the distance of the block roll from the adhesive roll remains constant.

For a more specialized adhesive application device such as that known from DE-19,532,582.6 described above, the problem is solved by pivoting a unit consisting of an adhesive chamber with an adhesive roll and a sealing roll about a lateral axis parallel to the axis of the block roll. A clearance element, supported so as to be movable, is arranged between a journal or sector concentric with the axis of the adhesive roll and a radial cam which can be turned with the adjusting lever. An elastic device which impinges on the unit presses the journal of the adhesive roll against the clearance element. The characteristics of the radial cam are selected such that when swinging the adjusting lever, the clearance of the axes of the adhesive roll and of the block roll remain constant.

In the adhesive application device according to the present invention, for purposes of engagement on and disengagement from the workpiece carrier, the block roll can be pivoted, between the pivot axis of the adjustment lever and the axis of rotation of the block roll, with a short lever arm adjustment lever length and a large pivot lever pivot angle. A lesser acceleration results. Consequently, the inertia occurring over the overall adjusting path during adjustment, that is acceleration and delay, can be kept slight.

It is practical for the clearance element to take the form of a lever pivoted in the machine framework and having a swiveling axis parallel to the axis of the block roll.

An additional configuration of the invention provides for the clearance element to be supported against the journal of an adhesive roll by an adjustable cam. As a result, the thickness of the adhesive deposit removed by the block from the adhesive roll can be adjusted.

It is practical for the clearance element to be supported against the radial cam by a roller.

An additional configuration of the invention provides for an F E Z adhesive roll to be supported in an adjusting lever, provided with an adjusting drive, eccentrically relative to the swiveling axis of the adjusting lever. The thickness of an adhesive deposit on the adhesive roll, therefore, also can be adjusted by the adjusting drive.

BRIEF DESCRIPTION OF THE DRAWINGS

An embodiment of the invention is explained in greater detail in the following with the aid of the drawings.

DESCRIPTION OF THE PREFERRED EMBODIMENT

Figure 1:
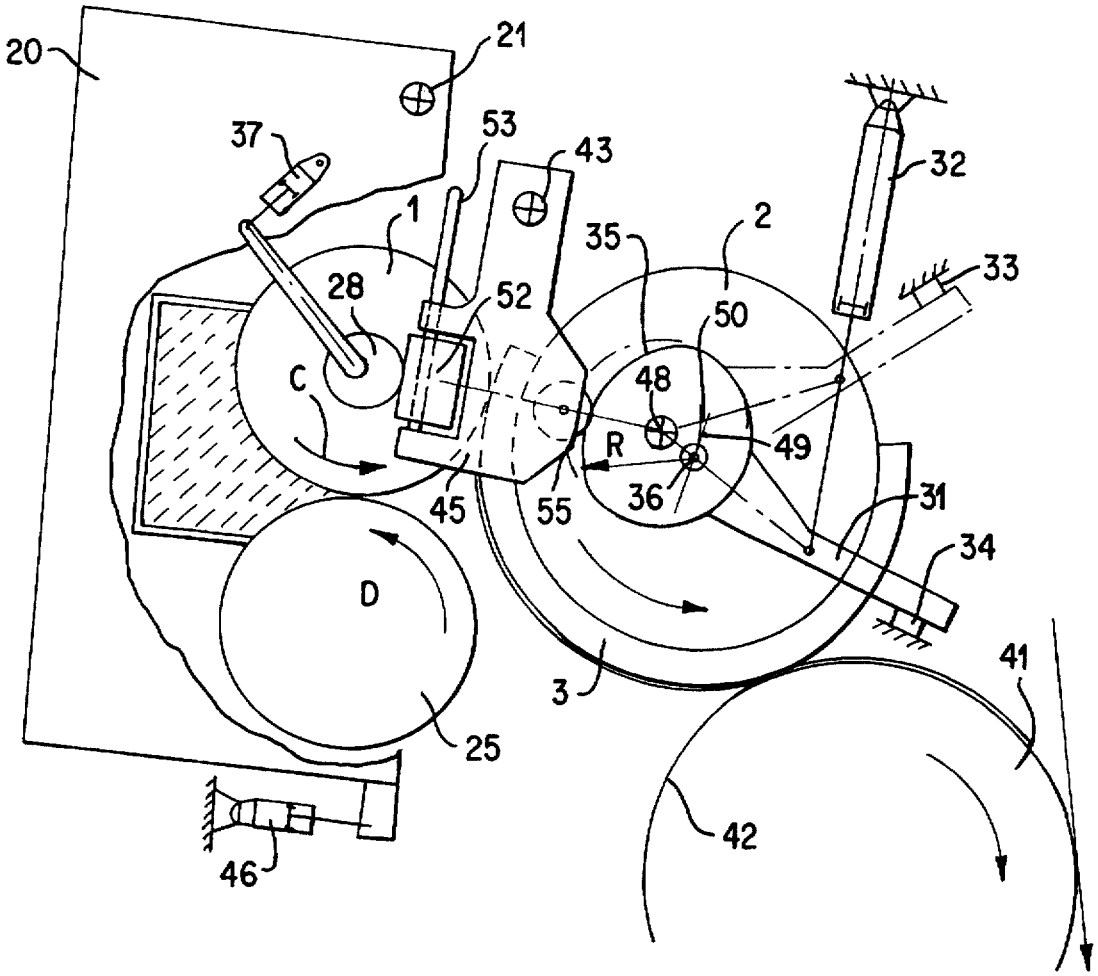
FIG. 1 is a top view of an adhesive application device in accordance with the invention.
Figure 2:
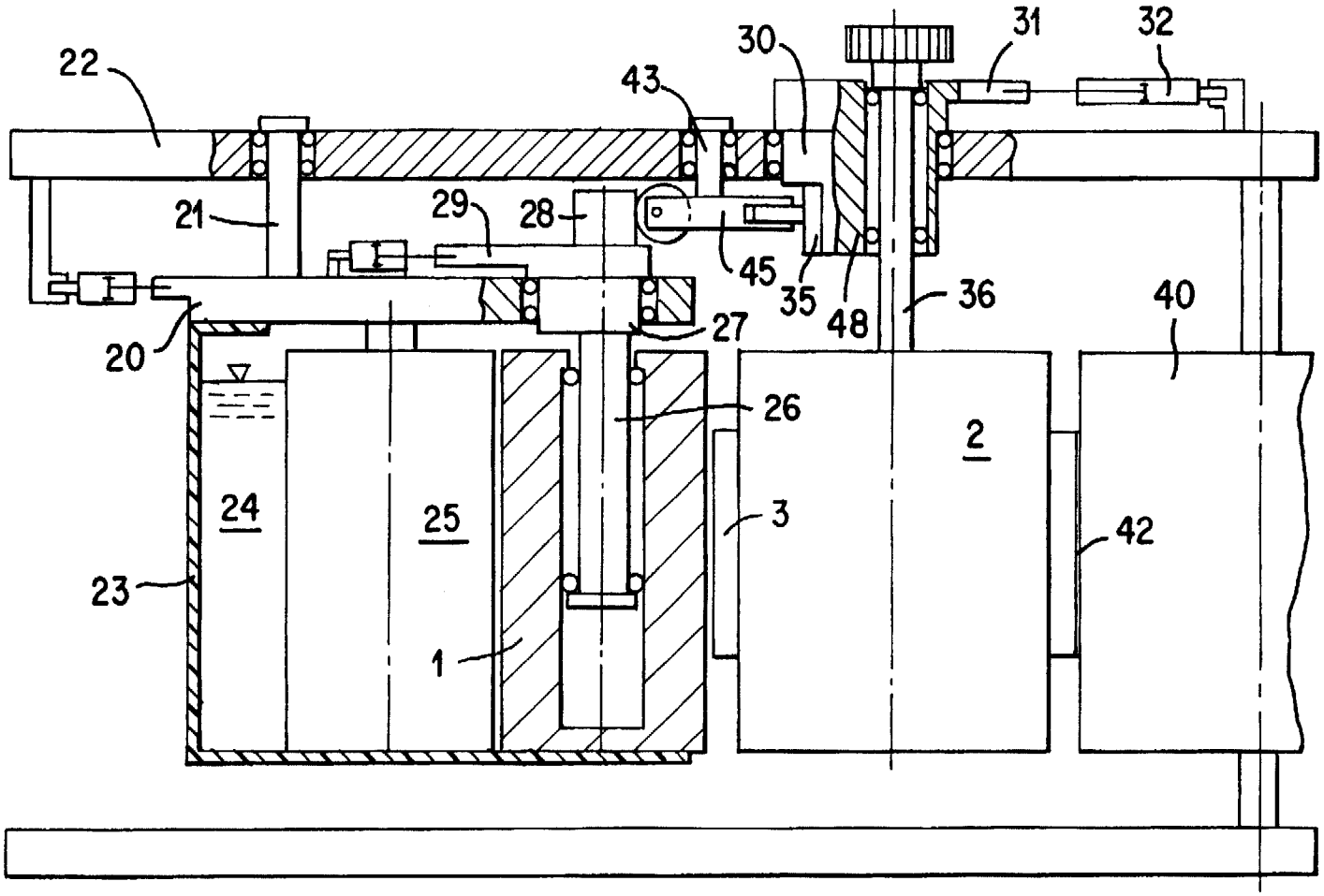
FIG. 2 is a sectional view of the adhesive application device of FIG. 1, FIGS. 3–5, as noted above, show a known pivoted support for a block roll, and FIGS. 6–8, as noted above, show a known pivoted support similar to that shown in FIGS. 3–5 but including a shorter lever.
Figure 3:
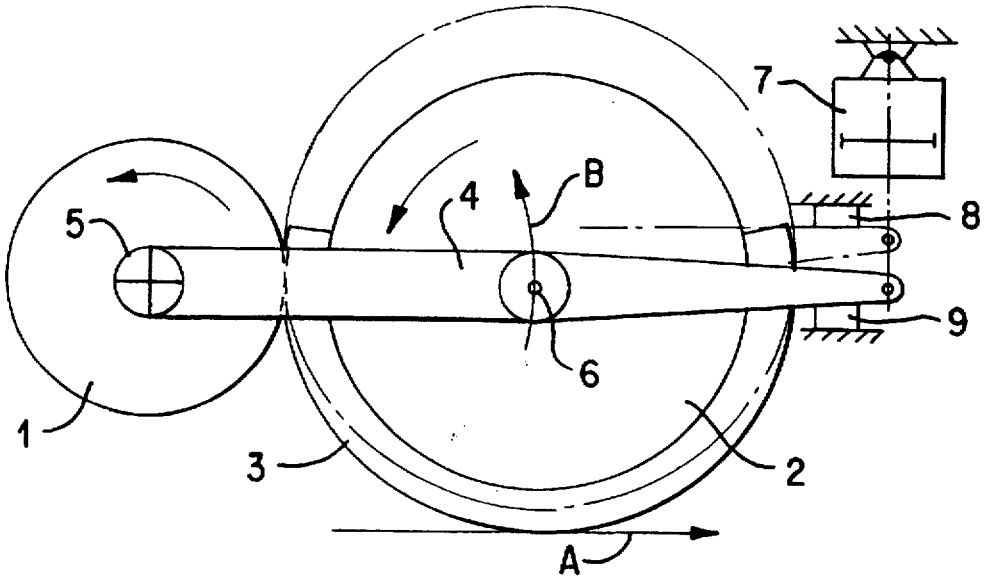
FIG. 3 PRIOR ART
Figure 4:
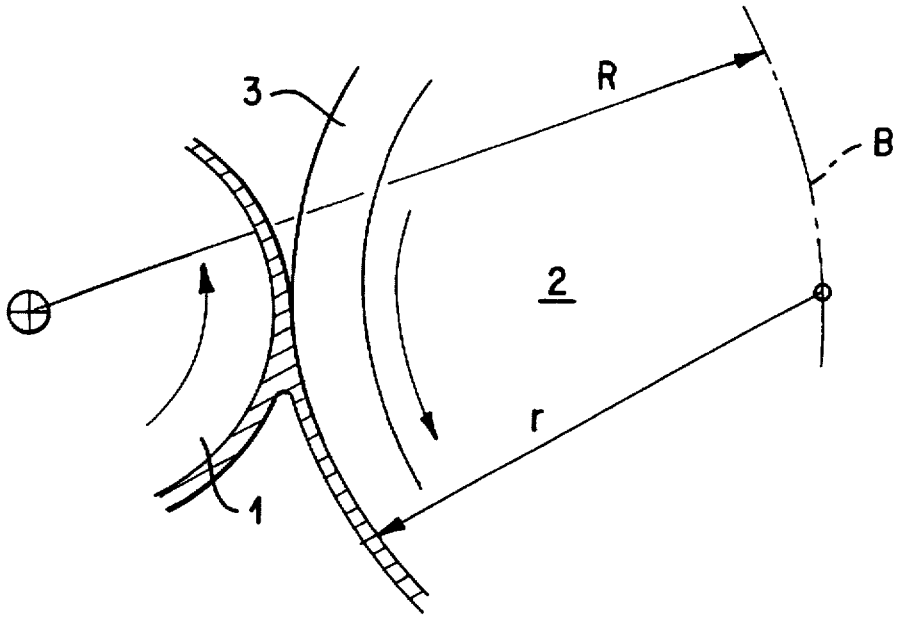
FIG. 4 PRIOR ART
Figure 5:
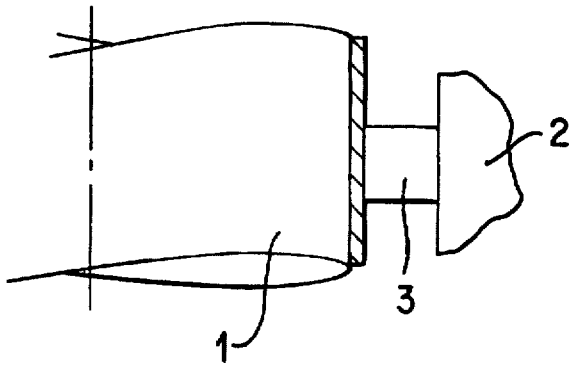
FIG. 5 PRIOR ART
Figure 6:
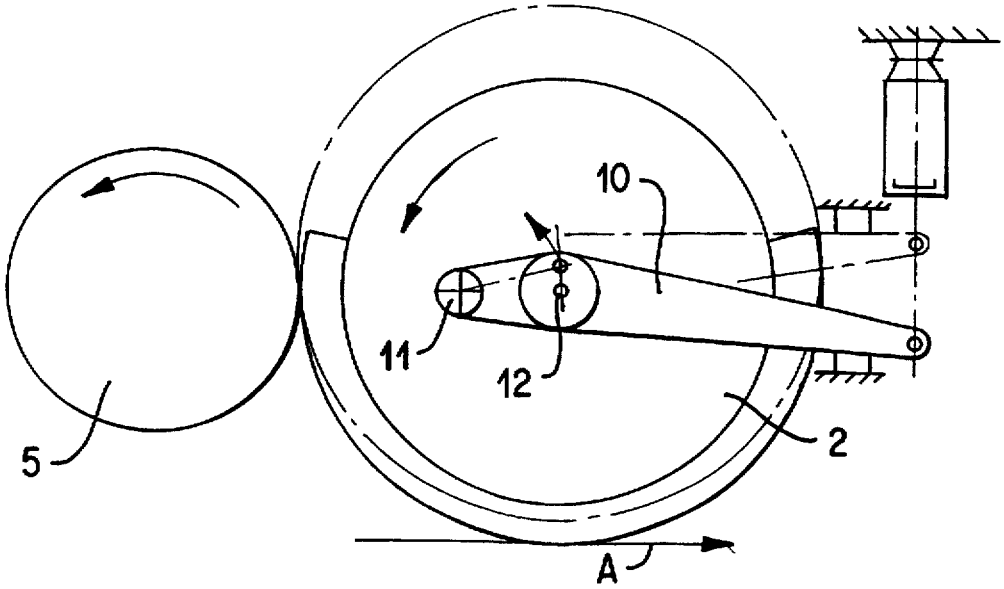
FIG. 6 PRIOR ART
Figure 7:
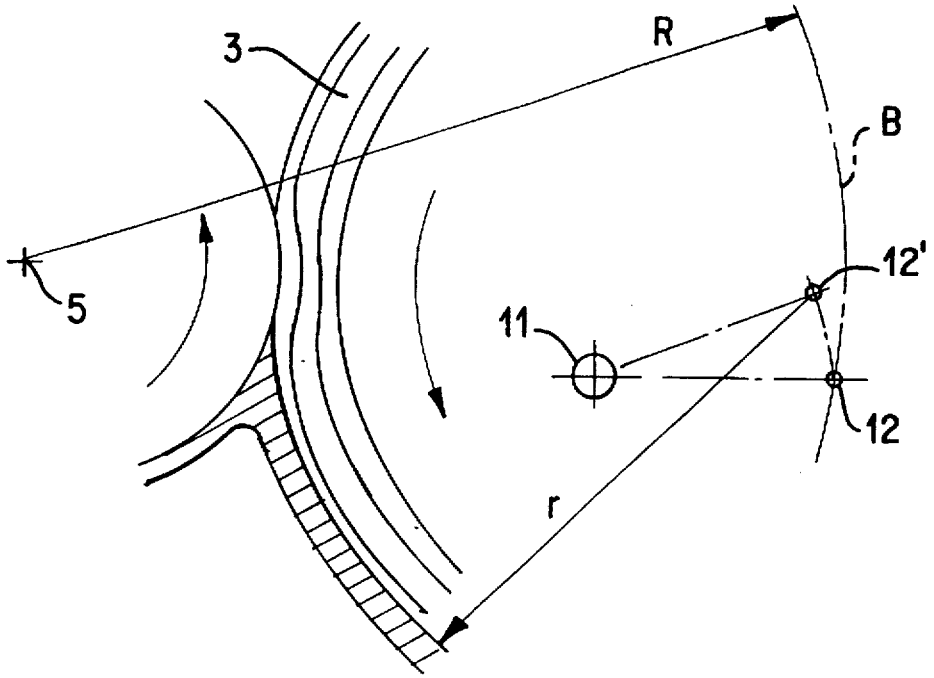
FIG. 7 PRIOR ART
Figure 8:
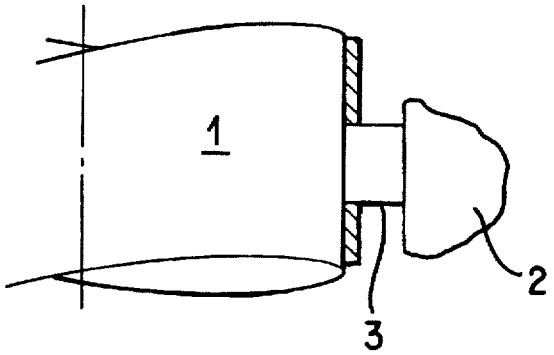
FIG. 8 PRIOR ART

An adhesive chamber (23) is held in a frame, housing or supporting plate (20) which, as shown in FIG. 1, is supported by a lateral journal (21) so as to freely turn. The housing or supporting plate is suspended in a plate or carrier (22) of the machine framework. The adhesive chamber (23) is filled with adhesive (24) up to the level shown in FIG. 2. Adhesive can be supplied and, if necessary, also carried off by lines which are not represented. A sealing roll (25) is pivoted in the plate (20). In addition, a cylindrical disk (27), both sides of which are provided with eccentric journals (26,28), is pivoted in the plate (20). An adhesive roll (1) is supported by the eccentric journal (26) projecting downward. A cylindrical disk (27) is connected to an adjusting lever (29) which, by an adjusting drive (37), such as a hydraulic agent piston cylinder unit, is provided in order to adjust the thickness of the adhesive layer taken up by the adhesive cylinder (1).

The adhesive roll (1) and the sealing roll (25) are provided with drives which drive the rolls in the directions of arrows C and D, respectively. The particular configurations of the adhesive chamber, adhesive rolls and sealing rolls, as well as of their drives, are known from the adhesive application device forming the subject matter of DE 19.532.582.6.

A cylindrical disk (30) is supported so as to freely turn in the carrier (22) of a machine framework. The disk (30) is connected to a radially projecting adjusting lever (31) which, by a pneumatic cylinder (32) supported in the machine framework, can swing between the limit stops (33,34) fixed to the framework.

The bottom side of the cylindrical disk serves as a support and carries a cam plate (35).

A journal (36) of the block cylinder (2) is supported eccentrically in a cylindrical disk (30). By swinging the adjusting lever (31) with the adjusting drive (32), the eccentricity of the support of the block roll (2) in the cylindrical bearing disk (30) allows the roll to be engaged with and disengaged from a clamping cylinder (4 0). The clamping cylinder (40) is provided with grips (41) which grasp the leading edge of a workpiece to be provided with a glue deposit.

A freely rotating vertical bearing journal (43) is supported in the carrier (22) of the machine framework. The vertical bearing journal (43) carries a radial lever clearance element (45) which forms a clearance element, one side of which is supported against a journal (28), projecting vertically upward and flush with the bearing journal (26) of the adhesive roll (1), and the other side of which is supported against the radial cam (35). In order to guarantee good seating, the side of the plate (20) located opposite to the bearing journal (21) is impinged on by an elastic element such as a pneumatic cylinder (46) which presses the journal, (28) against the clearance element (45) and consequently holds the opposite side of the clearance element in contact with the radial cam (35).

The characteristics of the radial cam are selected such that when the clearance element is in contact with both the journal (28) and the radial cam (35), the clearance between the axes of rotation of the adhesive roll (1) and of the block roll (2) remains constant when swinging the block roll (2).

When the adjusting lever (31) swings about the swiveling axis (48) of the lever (31), the turning axis (36) of the block cylinder (2) moves along the arc (49). The deviation of the arc (49), shown in FIG. 1, from the circle (50), concentric to the turning axis of the adhesive roll (1), is compensated for by the shape of the radial cam (35).

A clearance element having a lever (45) features an eccentric pin (52) between forked legs. The pin (52) has an eccentricity which can be adjusted by twisting a shaft (53). By twisting the eccentric pin (52), the effective width of the clearance element (45) and, hence, the thickness of a glue deposit taken over by a block (3) can be adjusted. A roller (55) is supported on the opposite side of the clearance element (45) and supports the clearance element (45) on the radial cam (35).

I claim:

1. An adhesive application device comprising:

an adhesive chamber for accepting adhesive, an adhesive roll which dips partially into the adhesive, a block roll for spreading glue onto a workpiece, and a clamping device for guiding the workpiece past the block roll so that, in absence of a workpiece, a turning axis of the block roll is swung away from the clamping device on an eccentric axis which does not coincide with a rotational axis of the adhesive roll, wherein one of the turning axis of the block roll and the rotational axis of the adhesive roll is guided so as to be movable in such a way that a distance of the block roll from the adhesive roll remains constant.

2. The adhesive application device of claim 1, wherein a front side of said adhesive chamber is closed by the adhesive roll, the adhesive roll has a vertical turning axis which, with a vertical lateral wall of the chamber, borders a return opening for adhesive deposits not removed, and further comprising:

a sealing roll, the adhesive chamber being closed by said sealing roll, said sealing roll being parallel to the adhesive roll and, with the adhesive roll, forming a passage opening for adhesive, said sealing roll being sealed with respect to another vertical lateral wall of the chamber by a sealing means, the block roll, adjustable to the adhesive roll, taking over formatted glue deposits from the adhesive roll and transferring the deposits to a workpiece to be provided with an adhesive coating, a pivoted adjusting lever, which supports the block roll eccentric to the pivot axis of the adjusting lever with an eccentricity which is less than a radius of the block roll and which moves the block roll away from a workpiece carrier in the absence of a workpiece to be provided with an adhesive coating, means for pivoting a unit including the adhesive chamber, the adhesive roll and the sealing roll, in machine framework, about a lateral axis parallel to the axis of the block roll, a clearance element, supported so as to be movable, arranged between a sector or journal concentric to the rotational axis of the adhesive roll, a radial cam which can be turned with the adjusting lever, and an elastic device impinging on the unit and pressing the journal against the clearance element, characteristics of the radial cam being selected such that when swinging the adjusting lever, a clearance between the axes of the adhesive roll and the block roll remains constant.

3. The adhesive application device of claim 2, wherein the clearance element includes a lever, pivoted in the machine framework, which has a swiveling axis parallel to the axis of the block roll.

4. The adhesive application device of claim 2, wherein the clearance element is supported on a journal of the adhesive roll by an adjustable eccentric.

5. The adhesive application device of claim 2, wherein the clearance element is supported by a roller of the radial cam.

6. The adhesive application device of claim 2, wherein the adhesive roll has an adjusting lever provided with an adjusting drive and is supported eccentric to a pivot axis of the adjusting lever.

7. The adhesive application device of claim 3, wherein the clearance element is supported on a journal of the adhesive roll by an adjustable eccentric.

8. The adhesive application device of claim 3, wherein the clearance element is supported by a roller of the radial cam.

9. The adhesive application device of claim 4, wherein the clearance element is supported by a roller of the radial cam.

10. The adhesive application device of claim 3, wherein the adhesive roll has an adjusting lever provided with an adjusting drive and is supported eccentric to a pivot axis of the adjusting lever.

11. The adhesive application device of claim 4, wherein the adhesive roll has an adjusting lever provided with an adjusting drive and is supported eccentric to a pivot axis of the adjusting lever.

12. The adhesive application device of claim 5, wherein the adhesive roll has an adjusting lever provided with an adjusting drive and is supported eccentric to a pivot axis of the adjusting lever.

* * * * *